United States Patent [19]

Petit

[11] 4,033,097

[45] July 5, 1977

[54] RIDING SADDLE

[76] Inventor: Michel Petit, 3, Avenue Branly, 78220 Viroflay, France

[22] Filed: June 9, 1975

[21] Appl. No.: 584,970

[30] Foreign Application Priority Data

June 12, 1974 France ..... 74.20366

[52] U.S. Cl. ..... 54/44; 54/46

[51] Int. Cl.[2] ..... B68C 1/00

[58] Field of Search ..... 54/37, 44, 45, 46, 66; 297/199, 200; 224/6, 42.11

[56] References Cited

UNITED STATES PATENTS 3,343,338 9/1967 Stubben ..... 54/44

FOREIGN PATENTS OR APPLICATIONS 569,663 2/1933 Germany ..... 54/44

584,194 9/1933 Germany ..... 54/44

*Primary Examiner*—Louis G. Mancene

*Assistant Examiner*—Peter K. Skiff

*Attorney, Agent, or Firm*—Young & Thompson

[57] ABSTRACT

The saddle has a seat formed by two inflatable cushions disposed on each side of the median plane of the saddle. A pommel constituted by an upwardly projecting inflatable curved element is assembled with the front edge of the cushions. An inflatable cantle is assembled with the rear edge of the seat.

15 Claims, 3 Drawing Figures

RIDING SADDLE

Conventional saddles, whatever their type, comprise a bow of wood or steel which constitutes a rigid reinforcement on which bands of leather are held taut, these bands supporting the seat and the other parts receiving the contact of the rider and various accessories such as stirrup leathers, girth leathers and the crupper. The saddle bow thus provides the necessary rigidity which however results in a lack of comfort for the rider who, unless he is very experienced, has difficulty in finding and maintaining a good seat. The horse, when trotting or galloping undergoes the pounding due to the weight of the rider and is liable to fatigue.

An object of the invention is to overcome these drawbacks by providing a radically novel form of riding saddle wherein the seat is formed by two inflatable cushions disposed on each side of the median plane on the front edge of which there is assembled a pommel constitued by a curved upwardly projecting element which is also inflatable.

The curved shape of the pommel produces an arch effect which provides the required rigidity for the whole of the saddle and renders superfluous the conventional saddle bow. However, this rigidity is combined with a certain flexibility due to the inflation of deformable walls so that the horse feels much more free. This liberty of movement is still further enhanced by the arrangement of the inflated and curved pommel above the seat. Owing to the presence of inflatable seat cushions, which have a shock-absorbing function, the horse is no longer subjected to the pounding of the weight of the rider at each beat and is much less tired.

As concerns the rider, he benefits from an imcomparable comfort. Installed on a soft seat and made confident by the presence of the pommel which protects him in the front, the rider immediately finds the correct seat with no need to learn to find it so that he is able to concentrate his attention on his hands and legs with the feeling of very considerable safety. He no longer experiences repeated shocks when trotting or galloping.

The comfort of the rider can be still further enhanced by the provision, in accordance with another feature of the invention, of a cantle which is also inflatable, assembled with the rear edge of the seat cushions and constructed for example in the shape of a crescent projecting from the top of the cushions. With this additional arrangement the rider on his saddle is as it were in an easy chair.

All the inflatable parts of the saddle proposed by the invention are constructed with materials employed in the construction of conventional inflatable structures, preferably of fabric coated with an elastomer. The false quarters and the quarters of the saddle may also be constructed from a coated fabric and assembled by stitching, welding and/or vulcanization to the bottom of the seat cushions. As concerns the stirrup leathers, girth leathers and bands of leather for attaching the crupper, the lunge-breast strap and other accessories, they may be made from coated fabric or from an elastomer or plastomer.

The pommel is advantageously constituted by two inflatable bags disposed symmetrically with respect to the median plane of the saddle and connected to the front edge of the respective seat cushions by stitching, welding and/or vulcanization and connected to each other in the upper part by a rigid bar constituting a handle which enables the rider, in the absence of the grip constituted in conventional saddles by the curved centre part of the pommel, to heave himself up onto his mount. Owing to the large notch thus defined between the two inflatable bags, the median zone of the pommel is considerably clear of the withers of the horse which here again benefits from a liberty of movement that known saddles do not provide.

Each inflatable cushion is advantageously constructed in the manner of pneumatic mattresses in the form of longitudinal sausage-shaped elements which communicate with each other.

It will be understood that the elimination of the saddle bow and the possibility of employing light materials in the construction of the saddle provide the advantage of an appreciable saving in weight and a corresponding reduction in the manufacturing cost.

Another advantage is that the pressure of the inflation of the various pneumatic parts may be determined selectively so as to permit an adjustment of the saddle to the weight and the configuration of the rider.

Further, the saddle according to the invention may be constructed in accordance with slightly different configurations for its application to different riding stages or techniques: learning, normal riding, obstacles, long rides etc.

The invention will be described in the ensuing description with reference to the accompanying drawing in which.

Figure 1:
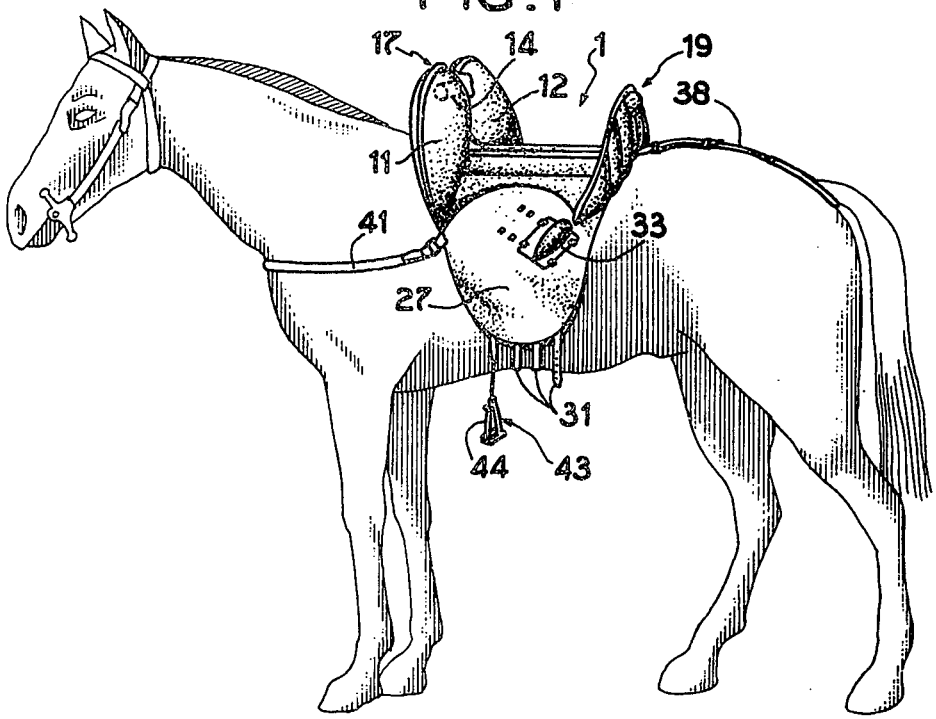
FIG. 1 is a perspective view of a horse equipped with a pneumatic saddle.
Figure 2:
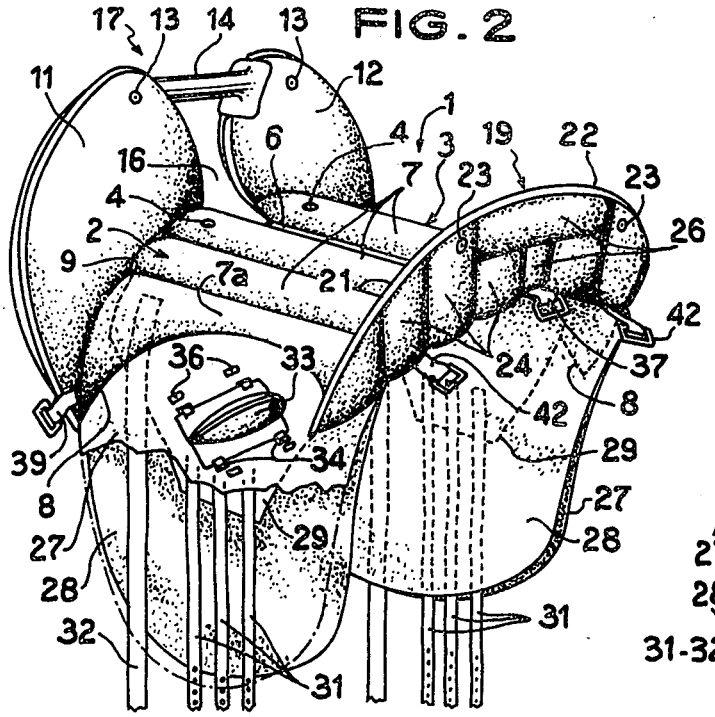
FIG. 2 is a perspective view, to an enlarged scale, of the saddle shown in FIG. 1.
Figure 3:
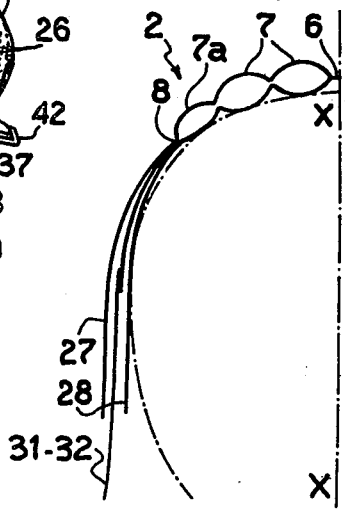
FIG. 3 is a diagrammatic cross-sectional view of the saddle.

The seat 1 of the saddle shown in the drawing comprises two cushions 2 and 3 which are separately inflatable by means of valves 4 and disposed symmetrically with respect to the median plane X—X of the saddle. These two cushions are interconnected by a centre connecting strip 6 and are each constituted by a plurality of longitudinal pads or small cushions 7 constituting chambers which intercommunicate by application of a technique employed in the construction of pneumatic mattresses. However, it should be mentioned that the lower end pad **7*a* instead of having a cylindrical shape as the other pads has a complex shape defined by the concave line of its lateral edge 8** as shown.

Assembled with the front edge 9 of each one of the cushions 2, 3 by its lower edge is a bag or bladder 11, 12 which is inflatable by means of a valve 13 and which, in the inflated state, is in the shape of a semi-crescent. The two bags 11, 12 are interconnected in the upper part by a rigid transverse bar 14 constituting a handle extending across a wide and deep centre notch 16 which permits an easy passage of the withers of the horse irrespective of the shape of the latter. The assembly formed by the two bags 11, 12 and handle 14 constitutes a curved element or pommel 17 which projects upwardly from the seat 1 and stiffens the saddle, this stiffness or rigidity being however tempered by the pneumatic nature of the bags 11, 12.

Assembled with the rear edge of the cushions 2, 3 by its lower edge is a cantle 19 in the shape of a crescent constituted by two elements 21, 22 which are inflatable separately by means of valves 23 and each comprise a plurality of vertical pads or small cushions 24 which are associated in the centre part of the cantle with connecting panels 26, for example of plastics foam material.

The quarters 27 and the false quarters 28 are connected to the lower face of the respective cushions 2, 3. The same is true in respect of intermediate panels 29 which have a triangular shape with a truncated lower corner and serve for the suspension of the girth leathers 31 and the stirrup leathers 32. Each quarter 27 also supports a small cushion or pad 33 which may be fixed by means of straps 34 in a position providing the rider with a support in the region of the hams so that he can hold his legs in the correct manner. The position of the support pads 33 may be adjusted by an appropriate choice of openings 36 provided for the passage of the fixing straps 34.

The saddle is completed by various attachments such as element 37 for fixing the cruppers 38, element 39 for fixing the linge-breast strap 41, element 42 for suspending satchels.

The stirrups 43 are preferably safety stirrups having one branch 44 of rubber.

The main part of the saddle, and in particular the pneumatic elements, the quarters and the false quarters, are of fabric coated with elastomer, so that the assemblies are effected without difficulty by adhesion and vulcanization. This same assembling method may be employed for fixing the girth leathers and the stirrup leathers to the panel 29 should these elements be themselves made from fabric coated with an elastomer.

If the two cushions 2, 3 form only a single pneumatic chamber comprising a single valve, it will be obvious that it is necessary to provide one or more pipes or transverse passages for putting the two cushions in communication with each other.

Having now described my invention, what I claim is new and desire to secure by Letters Patent is:

1. A riding saddle structure comprising in combination: a seat for directly receiving the body of the rider, which seat consists essentially of two inflatable cushions disposed on each side of the median plane of the saddle structure; and a pommel which consists essentially of an upwardly projecting substantially flexible and substantially inflatable curved structure, a flexible interconnection of the curved structure and a front edge of the cushions, the front part of the saddle structure deriving a relative rigidity solely from the bending of said flexible interconnection to a downwardly concave configuration to the exclusion of a conventional bow, and means to attach the saddle to a horse.

2. A saddle structure as claimed in claim 1, wherein the two cushions of the seat are inflatable independently of each other.

3. A saddle structure as claimed in claim 1, wherein each cushion comprises longitudinal sausage-shaped pads having interiors which communicate with each other.

4. A saddle structure as claimed in claim 1, comprising a handle enabling the rider to heave himself up onto his mount.

5. A saddle structure as claimed in claim 1, wherein the pommel consists essentially of two bags which are separately inflatable and a rigid bar constituting a handle interconnecting upper parts of the two bags.

6. A saddle structure as claimed in claim 1, comprising an inflatable cantle assembled with a rear edge of the seat.

7. A saddle structure as claimed in claim 6, wherein the cantle comprises two elements which are separately inflatable.

8. A saddle structure as claimed in claim 6, wherein the cantle has the shape of a crescent.

9. A saddle structure as claimed in claim 1, wherein each quarter of the saddle is provided with a pad acting as a support for the ham of the rider.

10. A saddle structure as claimed in claim 9, wherein the position of the support pad is adjustable.

11. A saddle structure as claimed in claim 1, wherein the inflatable cushions and pommel are of a fabric coated with an elastomer.

12. A saddle structure as claimed in claim 6, wherein the inflatable cushions, cantle and pommel are of a fabric coated with an elastomer.

13. A flexible riding saddle structure comprising in combination: a flexible seat for directly receiving the body of the rider, which seat consists essentially of two inflatable and flexible air cushions disposed on each side of the median plane of the saddle structure, the cushions terminating short of the quarters of the saddle structure; a pommel which consists essentially of a substantially flexible and substantially inflatable arch-shaped curved structure attached to and upwardly projecting from the front of the seat, a flexible interconnection of the curved structure and the cushions, the bending of said flexible interconnection of the pommel and cushions to a downwardly concave configuration imparting sufficient rigidity to permit avoiding the use of a rigid bow in the saddle structure, and means to attach the saddle to a horse.

14. A saddle structure as claimed in claim 13, wherein the inflatable curved structure defines an inner arch-shaped surface having an upper part which is capable of defining an upper gap with the withers of the horse.

15. A saddle structure as claimed in claim 13, wherein the seat cushions terminate in a lower concave arcuate contour as viewed in side elevation.

* * * * *